US008253073B2

(12) United States Patent
Marcotte

(10) Patent No.: US 8,253,073 B2
(45) Date of Patent: Aug. 28, 2012

(54) RETRACTABLE HOSE REEL AND ENCLOSURE

(76) Inventor: Christy Lynn Marcotte, Lowell, IN (US)

( * ) Notice: Subject to any disclaimer, the term of this patent is extended or adjusted under 35 U.S.C. 154(b) by 735 days.

(21) Appl. No.: 12/322,626

(22) Filed: Feb. 6, 2009

(65) Prior Publication Data

US 2010/0200559 A1 Aug. 12, 2010

(51) Int. Cl.
*H05B 1/00* (2006.01)
*B65H 75/34* (2006.01)
*B65H 75/38* (2006.01)

(52) U.S. Cl. ..... 219/214; 242/403; 137/355.16; 239/195; 239/196; 239/197; 239/198; 239/736; 239/745

(58) Field of Classification Search ..... 219/214
See application file for complete search history.

(56) References Cited

U.S. PATENT DOCUMENTS

| | | | | |
|---|---|---|---|---|
| 4,365,139 | A * | 12/1982 | Dannatt | 219/216 |
| 5,568,824 | A * | 10/1996 | Cordrey | 137/355.27 |
| 6,564,011 | B1 * | 5/2003 | Janoff et al. | 392/480 |
| 2007/0140672 | A1 * | 6/2007 | Fellinger | 392/447 |
| 2009/0223585 | A1 * | 9/2009 | Buller | 138/110 |

* cited by examiner

*Primary Examiner* — Joseph M Pelham
*Assistant Examiner* — Diallo I Duniver
(74) *Attorney, Agent, or Firm* — Thomas G. Raffin; Claude T. Anderson

(57) ABSTRACT

A hose heater for use in outdoor or unheated interior spaces of a home, construction office or farm. The hose heater includes an enclosure having a hose reel for storing the hose also having an electrical heating unit to warm the stored hose between uses. A heating core located in the center of the reel provides heat, keeping the hose from freezing. The enclosure which itself may be heated or unheated, blankets the hose to provide heat to the outer hose coils to ensure that the extremities are maintained at a freeze-free temperature. This can be used in small scale farming, outside use, and other areas where animals and ice rinks need watering in winter with a hose.

15 Claims, 4 Drawing Sheets

RETRACTABLE HOSE REEL AND ENCLOSURE

BACKGROUND OF THE INVENTION

Outdoor watering is often preferred to be done with hoses because it allows inexpensive flexibility to where the water is used. For example, in livestock watering it is often desirable to rotate watering sites to minimize livestock stress at any one location. Cold weather outdoor watering is often problematic because hoses must often be located in warm structures considerable distances from where they are used, and can often freeze during the time it takes to move and set the hose up. Since out-buildings more often have electrical service than are heated, often the only feasible options for watering livestock or outdoor pets include either expensive permanent installations or hand carrying the water.

The present invention generally relates to a convenient hose heater which is amenable to a portable and fixed installation, and, in particular, to a hose heater for freeze protection and watering purposes outside buildings during winter.

Various methods and means have been used throughout history for heating water, however most are either fixed, and run with heating units and insulation surrounding the exterior of the hose, or coiled around the hose over the entire length of the hose. A hose heated with these methods is expensive to purchase and operate, bulky, cannot be coiled around a hose reel, is difficult to insulate use and use.

Passive solar heaters are also used to heat water, however these are dependent upon direct sunlight for heat, which in winter is not reliably available. If there is a sunless day, the hose and the water therein will freeze, and the hose will be unavailable for use.

Another option is to have an external water heater, or a water heater installed indoors, with the associated hoses hooked up prior to use and de-coupled after use for inside storage. This, of course, is extremely expensive and cumbersome to do on e routine basis.

A need exists for an inexpensive device that can prevent the freezing of hoses during cold weather and still provide the convenience of use of hoses similarly to warmer weather conditions.

BRIEF SUMMARY OF THE INVENTION

In its various embodiments, the hose heater allows for heating of the entire length of the hose while it is coiled on the reel, not while the hose is extended. This can be used in small scale farming, outside use, and other areas where animals and ice rinks need watering in winter with a hose. The hose heater will fit any conventional garden hose, therefore users can use the hose they already have. This device includes an enclosure which allows for a large amount of hose length to be kept warm protected from a freezing environment, while minimizing heat loss and keeping the hose and water from freezing.

The hose heater provides an electrical heating unit which warms any conventional garden hose to keep it from freezing. A heating core which may be located in the center of a hose reel provides heat, keeping the hose from freezing. An enclosure can cover and insulate the coiled hose to maintain the heat to the outer hose coils to ensure that the extremities are maintained at a freeze-free temperature. Generally an electrical heating element is provided to warm the enclosure. The electrical heating element is typically a self-regulating electric heat tracing as known in the art. Alternatively, the electrical heating element may include a controller receiving a signal from a temperature sensor such as a thermostat, thermocouple or thermister.

The insulated enclosure structure itself may be heated or unheated. The enclosure may be constructed as a rigid unit (box-like design), a flexible unit (flexible bag or sack type shape), or semi-rigid having a flexible covering with stiffening elements to provide some structure to an otherwise flexible shape. Of course the insulated enclosure structure can use a mixture of the various construction options to achieve an optimized design.

The preferred enclosure cover has an access hatch that may be an insulated canvas cover with snaps. An alternative embodiment may include a rigid hinged cover.

The hose heater may contain a hose reel, and can therefore be located anywhere a conventional reel is found. The hose heater can be wall mounted, box mounted, or mounted on a trailer of cart.

Significantly, the hose heater is easy to operate simply by plugging into a wall outlet. Alternatively, the hose heater may be operated with a low voltage DC power source based on batteries recharged from a conventional AC source or solar cells.

The hose heater is also easy to repair as it has few parts and easy functional understandability.

The hose heater may be of a lightweight design for ease of portability, or may be equipped with a handle and rollers for ease of relocation.

The hose material itself as well as the water remaining within the coiled hose serve as a heat sink to buffer temperature changes within the enclosure. This provides additional protection from freezing during short term temperature fluctuations such as when the access hatch is opened.

DETAILED DESCRIPTION OF THE PREFERRED EMBODIMENTS

The present invention involves a hose heater 10 that can be used to maintain freeze protection for hoses which must be used in the winter on a daily basis for such uses as watering animals, skating rinks, etc. The principles of the present invention, however, are not limited to these uses. People skilled in the art will see other obvious uses from examining the specifications herein.

Figure 1:
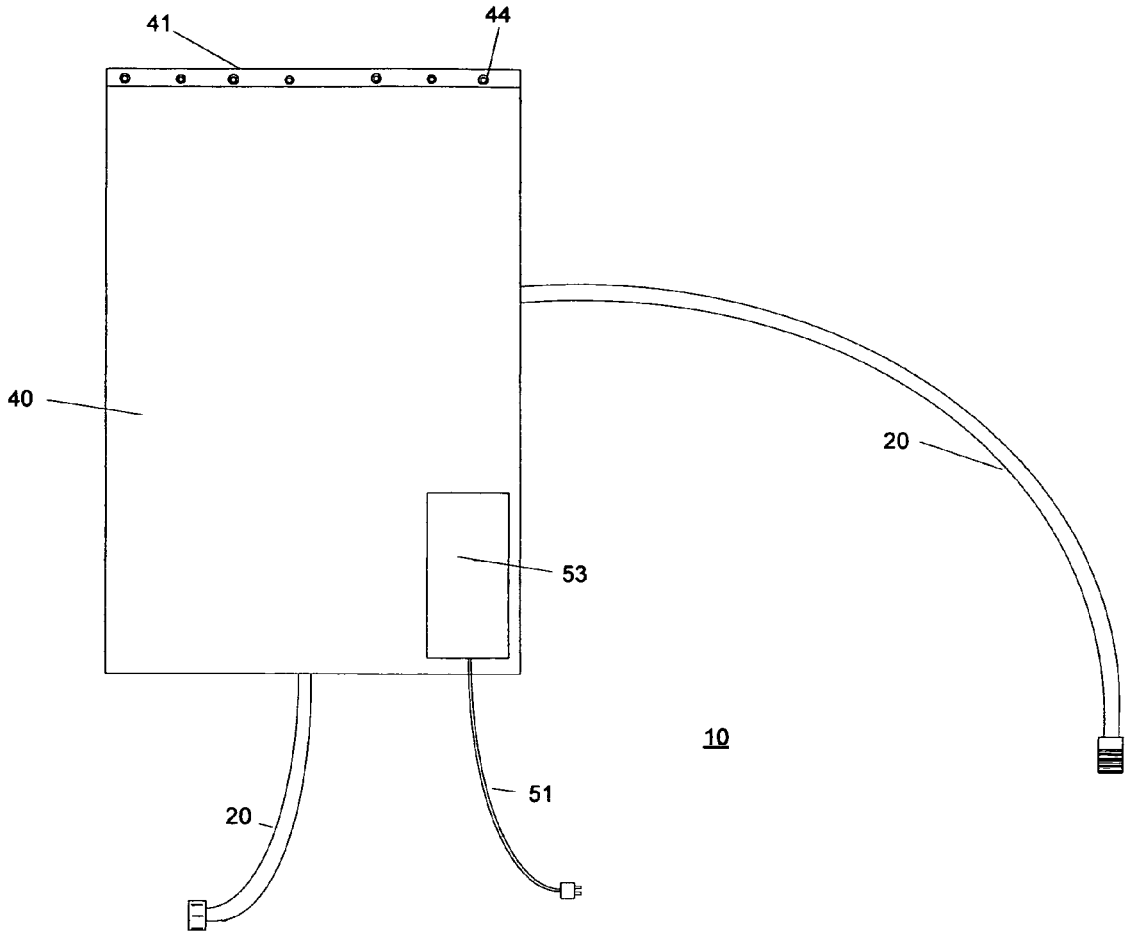
FIG. 1 is an elevational view of a rigid embodiment of the device.
Figure 2:
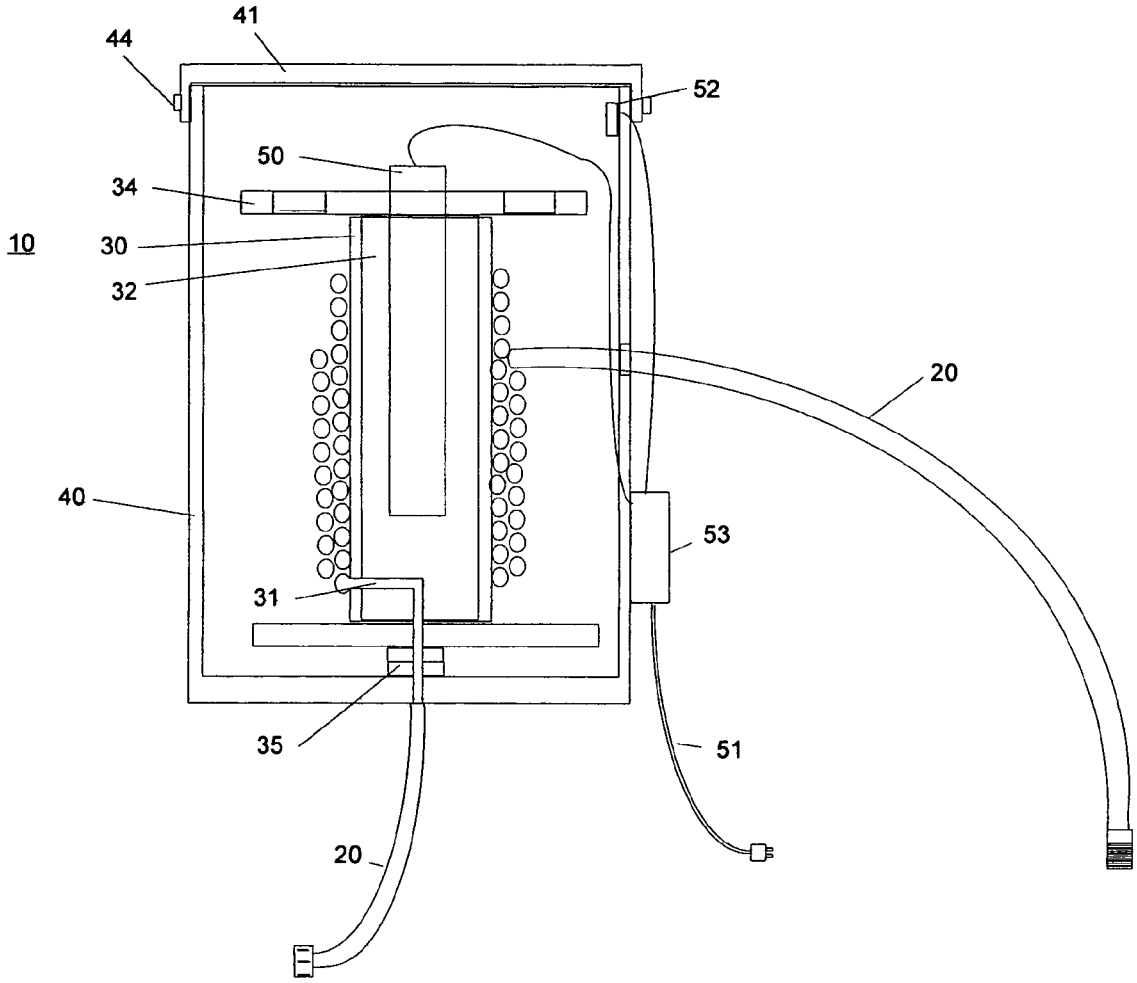
FIG. 2 is a cross-sectional view of a cross-sectional view of an embodiment of the device.
Figure 3:
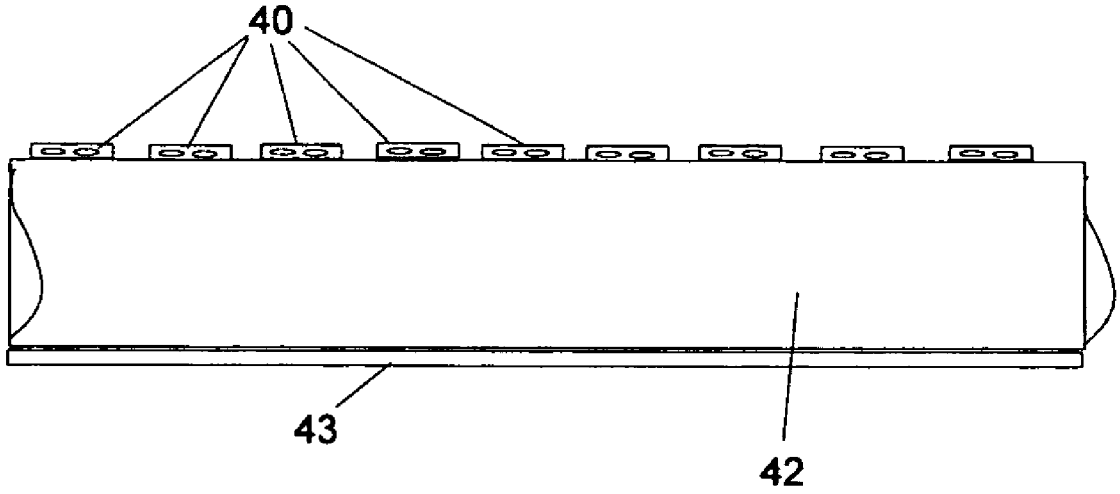
FIG. 3 is a cross-sectional view showing a possible embodiment of a portion of the enclosure.

As can be seen in FIGS. 1 and 2, a hose heater 10 includes an enclosure 40 surrounding a hose 20. Preferably, the hose 20 is coiled around a hose reel 30. Alternatively, the hose 20 may be coiled around an open space without the hose reel 30. The hose reel 30 may encompass an inner core 32 which may include an electrical heating element 50.

The hose 20 may be a typical garden hose provided and attached to the device by the user, or an integral hose may be included with the device. Allowing the user to select the hose 20 of choice increases flexibility for the user with regard to choice of hose durability, length and diameter and avoids duplicating other hoses the user may have. Utilizing an integral hose with the hose heater 10 allows the optimization of design parameters such as material selection, weight, collapsibility for automatic draining and other design considerations for specific applications.

The hose reel 30 may be provided to assist in retrieving the hose 20 into the enclosure 40. The hose reel 30 may include hose connectors for attaching incoming and outgoing hoses. Alternatively, the hose reel 30 may simply hold a single hose that is used for incoming and outgoing water. FIG. 2 shows an embodiment with a separate supply hose and a hose connector for attaching a garden hose. The hose connector 31 may include a standard hose fitting, a clamped hose fitting, a quick connect coupling or other standard hose and tubing attachment fittings. The hose reel 30 may include a swivel connector 35 for the hose 20. A swivel connector 35 could allow the hose reel 30 to rotate while incoming supply hose remains stationary.

The inner core 32 of the hose reel 30 may contain a rewind mechanism 34 and an electrical heating element 50. The rewind mechanism 34 may be a crank that is turned by hand, or of an automatic type that may include a spring or elastic band that is biased when the hose reel 30 rotates as the hose 20 is retracted. The hose reel 30 may be held in place by a latch mechanism while the hose is being used, and automatically retracted when the latch mechanism is released to rewind the hose 20.

Inner core 32 of the hose reel 30 may also contain the electrical heating element 50. A preferred electrical heating element 50 is a self-regulating electric heat trace. Alternative embodiments for electrical heating options include resistance heaters, infrared heaters or utilize the heat output of an incandescent light source are well known in the art. Placing the electrical heating element 50 within the hose reel 30 offers protection from damage during removal and retraction of the hose 20. The electrical heating element 50 may be of a non-rotating design within the hose reel 30 to simplify electrical connections. Alternatively the electrical heating element 50 may be designed to be disconnected during hose reel 30 operation or may include a swivel electrical connector and rotate with the hose reel 30 as the hose 20 is retracted and rewound in a similar manner as the rotating swivel connector 35 on the hose 20.

The enclosure 40 is preferably of a lightweight construction for easy portability. Preferable materials tend to have a high trapped air volume for light weight and good insulating properties. The enclosure 40 may be of a rigid, flexible or semi-rigid design. As shown in FIG. 1, an enclosure may include a box-like structure with an access hatch 41. The access hatch 41 may be an insulated canvas type material with snap fasteners. Alternatively, an embodiment of a rigid enclose may include a rigid insulation 42 layer such as expanded polymer that is lightweight and serves to provide rigidity. Examples of insulation 42 that have inherent rigidity include polystyrene, polyisocyanurate, and polyurethane. The insulation may be covered by a radiant barrier 43 to help retain heat within the enclosure 40 by reflecting the heat back into the enclosure 40. Examples of a radiant barrier 43 include a mylar or reflective aluminum film.

The access hatch 41 may be secured with a closing device 44 such as a hinge and latch, snaps, ties, zipper, snaps or a hook and loop material such as Velcro®.

The a light weight enclosure 40 constructed as a flexible embodiment may include insulation 42 of a flexible blanket nature such as fiberglass, rock wool, natural fibers or various synthetic polymer fibers. The enclosure may also use a radiant barrier 43 for heat retention. The access hatch 41 may be secured with a closing device 44 such as a cord tie, zipper, snaps or a hook and loop material such as Velcro®.

An enclosure 40 with a semi-rigid nature may be utilized by including structural stiffeners under a flexible insulation 42 blanket.

The electrical heating element 50 may be located anywhere to provide heat within the enclosure with preferred locations within the hose reel 30 or adjacent to or within the insulation 42 of the access hatch 41. Examples include heat tape or wires affixed to the inner surface of the insulation or embedded within the insulation. These locations offer potential physical support and protection of the electrical heating element 50.

Figure 4:
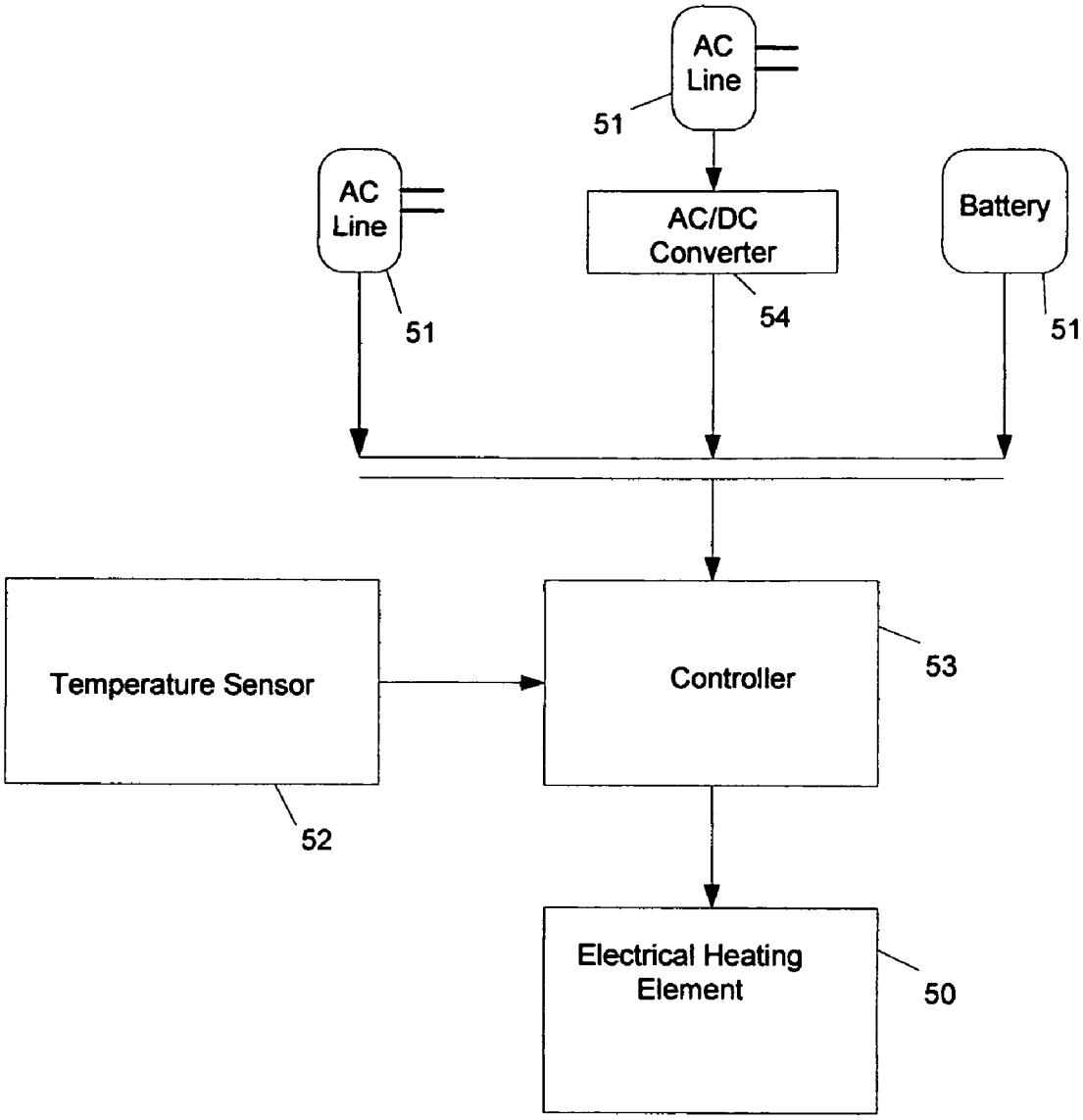
FIG. 4 is a schematic diagram of an embodiment representing several elements of the device.

The electrical heating element may be a self-regulating electric heat trace. The electrical heating element 50 may be a single unit or include a plurality of units. Multiple units may be sequentially activated by a controller 53 to provide for peak heat requirements. As shown in FIG. 4, a temperature sensor 52 may be used to provide a signal to a controller. The controller 53 turns the electrical heating element 50 on and off, or if the heating element is variable output, it may adjust the output the output as appropriate. The controller 53 may be incorporated with the heating element 50. Alternatively for low power heating elements 50 that can be left on continuously, a controller 53 may be unnecessary.

Electrical heating element 50 may be simple resistance heaters, carbon fiber wires for emitting infrared energy or incandescent lights may be used as a heat source to heat the interior of the enclosure. Other options for electrical heating are known by a person of ordinary skill in the art.

The electrical heating elements may be powered directly by an AC line energy or by low voltage DC energy operating of the AC line 51 source. Low voltage DC energy reduces the hazards associated with use of the electrical device. Low voltage DC may be obtained by an AC/DC converter 54 operating off of an AC line 51 source or from a battery source. The batteries may either be recharged as needed, or if desired through the use of electrical solar panels.

I claim:

1. A hose heater device to protect a hose from freezing comprising:

a hose reel;

an enclosure containing the hose reel;

the enclosure also being portable;

the enclosure having an insulating layer;

the enclosure also having an access hatch to provide access to the hose reel; and an electrical heating element to warm the enclosure, wherein the electrical heating element is within an inner core internal to the hose reel.

2. The device of claim 1 wherein the electrical heating element is a self-regulating electric heat trace.

3. The device of claim 1 having a controller to regulate the electrical heating element.

4. The device of claim 1 wherein the enclosure is of a rigid material.

5. The device of claim 1 wherein the enclosure is of a semi-rigid material.

6. The device of claim 1 wherein the enclosure is of a flexible material.

7. The device of claim 1 wherein the enclosure is a rigid material and the access hatch is a flexible material.

8. The device of claim 1 wherein hose reel is attached to a hose connector.

9. The device of claim 1 wherein the hose reel includes a rewind mechanism.

10. The device of claim 1 wherein the hose reel includes a rewind mechanism that is a crank.

11. The device of claim 1 wherein the enclosure is covered with a radiant barrier for retaining heat.

12. The device of claim 1 wherein the access hatch is sealed by a latching device selected from the group consisting of a latch, a snap, a zipper, a tie and a hook with loop material.

13. The device of claim 1 wherein the electrical heating element is powered by an electric supply selected from the group consisting of an AC line source, a DC battery source and a solar panel.

14. The device of claim 1 wherein the electrical heating element is an electrical resistance heater.

15. The device of claim 1 wherein the electrical heating element is an infrared heater.

* * * * *